US006190229B1

(12) United States Patent
Nadel et al.

(10) Patent No.: US 6,190,229 B1
(45) Date of Patent: Feb. 20, 2001

(54) FIBER OPTIC ENHANCED FIGURINE ASSEMBLY

(76) Inventors: Craig P. Nadel, 201 Wingate Rd., Parsippany, NJ (US) 07054; Dietmar Nagel, 11 South Rd., Chester, NJ (US) 07930

( * ) Notice: Under 35 U.S.C. 154(b), the term of this patent shall be extended for 0 days.

(21) Appl. No.: 08/365,584

(22) Filed: Dec. 28, 1994

(51) Int. Cl.[7] ..... A63H 33/22; A63H 3/44
(52) U.S. Cl. ..... 446/219; 446/485; 446/394
(58) Field of Search ..... 446/485, 219, 446/394; 362/32, 124, 8.8

(56) References Cited

U.S. PATENT DOCUMENTS 4,186,425 * 1/1980 Nadimi ..... 362/32
4,206,495 * 6/1980 McCastin ..... 362/32
4,529,193 * 7/1985 Kuhnsman ..... 446/485 X
4,622,771 * 11/1986 Spengler ..... 446/219 X
4,626,225 * 12/1986 Katzman et al ..... 446/394
4,998,186 * 3/1991 Cocca ..... 362/32 X
5,277,644 * 1/1994 Osborne et al. ..... 446/485 X
5,387,146 * 2/1995 Smith et al. ..... 446/485 X

FOREIGN PATENT DOCUMENTS

18769 * 2/1911 (GB) ..... 446/485

* cited by examiner

*Primary Examiner*—D. Neal Muir
(74) *Attorney, Agent, or Firm*—Cohen, Pontani, Lieberman & Pavane

(57) ABSTRACT

A fiber optic enhanced figurine assembly includes a figurine body having a figurine outer surface, and a bunch of fibers affixed to the figurine body and extending outwardly from the figurine outer surface. The fiber bunch includes a plurality of nonilluminatable fibers extending outwardly at least a first distance from the figurine outer surface. The fiber bunch further includes at least one illuminatable optical fiber that extends outwardly from the figurine outer surface to a second distance less than the first distance of the nonilluminatable fibers. The figurine assembly further includes a light source for selectively illuminating the at least one optical fiber to visually and decoratively enhance the fiber bunch.

10 Claims, 2 Drawing Sheets

FIBER OPTIC ENHANCED FIGURINE ASSEMBLY

FIELD OF THE INVENTION

The present invention generally relates to a fiber optic enhanced figurine assembly and, more particularly, to a figurine having a bunch of fibers extending outwardly therefrom with the fiber bunch including at least one optical fiber for predetermined illumination of at least a portion of the fiber bunch.

BACKGROUND OF THE INVENTION

A figurine will often include a bunch or bundle or otherwise-configured plurality of fibers extending outwardly therefrom to simulate hair or the like. An example of such a figurine is one having the shape and appearance of a horse wherein the fiber bunch extends from that portion of the figurine resembling the neck of a horse to thereby define a simulated mane. Such a figurine may also have a fiber bunch extending from that portion of the figurine resembling the rear of a horse to simulate a tail.

While the figurine and fiber bunch may be illuminated by a variety of light sources, such light sources are typically incapable of selectively and decoratively illuminating the fiber bunch while directing little, if any, light onto the figurine body. Thus, selectively highlighting the appearance of the fiber bunch by way of a light source which casts little, if any, light on the figurine is difficult, if not impossible, with conventional illumination sources.

A possible approach to selectively lighting the fiber bunch may be to direct a narrowly focused beam of light from a light source near the figurine toward the fiber bunch. Such an arrangement, however, would likely be cumbersone and bulky. Also, if the light source were attached to the figurine, such a structure would be complicated to assemble. Moreover, a source capable of emitting such a narrowly focused beam of light would ordinarily be unduly expensive.

OBJECT OF THE INVENTION

Accordingly, it is an object of the present invention to provide a fiber optic enhanced figurine assembly having a bunch of fibers affixed thereto with the fiber bunch including at least one optical fiber incorporated in the bunch to decoratively illuminate the fiber bunch.

It is a further object of the invention to provide a fiber optic enhanced figurine assembly having a bunch of fibers affixed thereto with the fiber bunch including a plurality of nonluminous fibers and at least one optical fiber to illuminate the fiber bunch.

It is a still further object of the invention to provide a fiber optic enhanced figurine assembly having a fiber bunch affixed thereto wherein the fiber bunch includes a plurality of optical fibers having different lengths generally less than the lengths of the nonilluminatable fibers to decoratively illuminate the fiber bunch longitudinally and integrally therewithin.

The various features of novelty which characterize the invention are pointed out with particularity in the claims annexed to and forming a part of the disclosure. For a better understanding of the invention, its operating advantages, and specific objects attained by its use, reference should be had to the accompanying drawings and descriptive matter in which there are illustrated and described preferred embodiments of the invention.

SUMMARY OF THE INVENTION

According to one aspect of the present invention, a fiber optic enhanced figurine assembly comprises a figurine body having a figurine outer surface, and a bunch of fibers affixed to the figurine and extending outwardly from the figurine outer surface. The fiber bunch includes a plurality of non-illuminatable fibers or strands extending outwardly at least a first distance from the figurine outer surface. The fiber bunch further includes at least one illuminatable optical fiber which extends outwardly from the figurine outer surface to a second distance less than the first distance of the nonilluminatable fibers. The figurine assembly further comprises an arrangement for selectively illuminating the at least one optical fiber to visually and decoratively enhance the fiber bunch.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DESCRIPTION OF THE DRAWINGS

In the drawings, wherein like reference characters denote similar elements throughout the several views.

DESCRIPTION OF THE PREFERRED EMBODIMENTS

Figure 1:
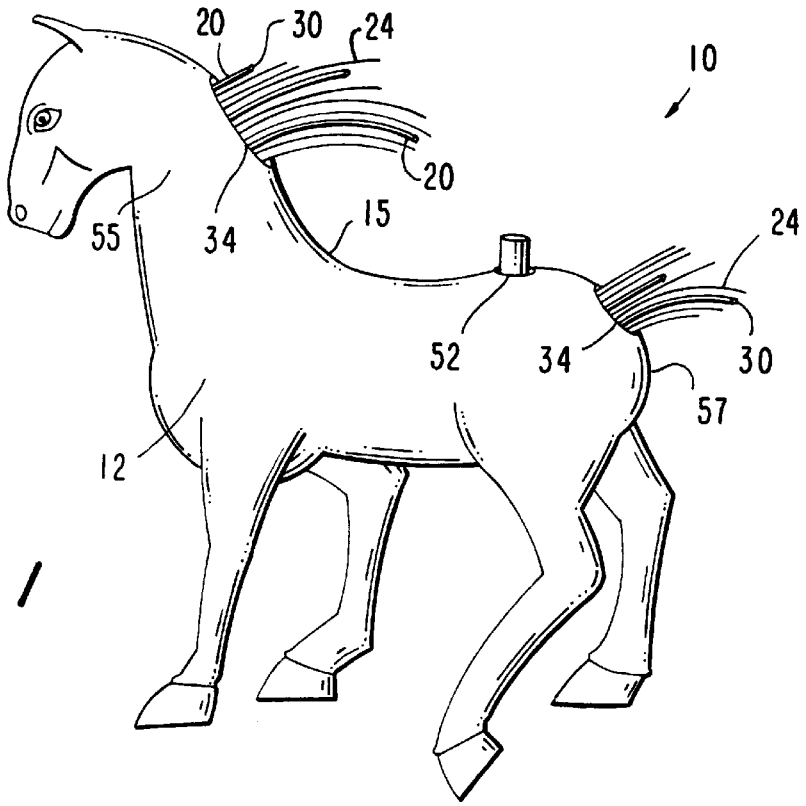
FIG. 1 is a side elevational view of a fiber optic enhanced figurine assembly constructed to simulate a horse in accordance with the present invention.

Referring now to the drawings, FIG. 1 illustrates a figurine assembly and, more particularly, a fiber optic enhanced figurine assembly identified by the general reference numeral 10 and constructed in accordance with the teachings of the present invention. Although the embodiment of the assembly 10 shown in FIG. 1 is in the form of a horse-shaped figurine 12, it is contemplated that the figurine may alternatively simulate the shape and appearance of any real or imaginary figure such, by way of example, as an animal, person, or vehicle or other object as a general matter of design choice.

Fundamentally, the figurine assembly 10 comprises a figurine 12 having a figurine body with a figurine outer surface 15. One or more bunches or bundles of associated or grouped pluralities of elongated strand-like fibers 17 are affixed to the figurine 12 and extend outwardly from the figurine outer surface 15 so as to simulate, by way of example, hair. Each such fiber bunch 17 is generally and primarily formed of nonilluminated or nonilluminatable (hereinafter nonluminous) strands or fibers of any appropriate material—i.e., strands that do not conduct or carry light or, at least, to which no illumination is applied—and, in addition, will integrally include at least one optical fiber 20 incorporated within the fiber bunch 17 and surrounded by nonilluminatable strands or fibers.

In a preferred form of the invention, each fiber bunch 17 includes a substantial plurality of optical fibers 20 integrally distributed throughout the bunch. The optical fibers 20 are preferably of a type such that, when a source of light or illumination is placed proximate one end of a length of the optical fiber, the light is carried or transmitted or communicated along its length so that the opposite end is illuminated while, at the same time, little or no illumination is visible along the length of the optical fiber intermediate its opposed ends. The figurine assembly 10 further comprises means 22 for thus illuminating one end of the at least one optical fiber 20 to visually enhance the decorative appearance of the fiber bunch 17.

Figure 2:
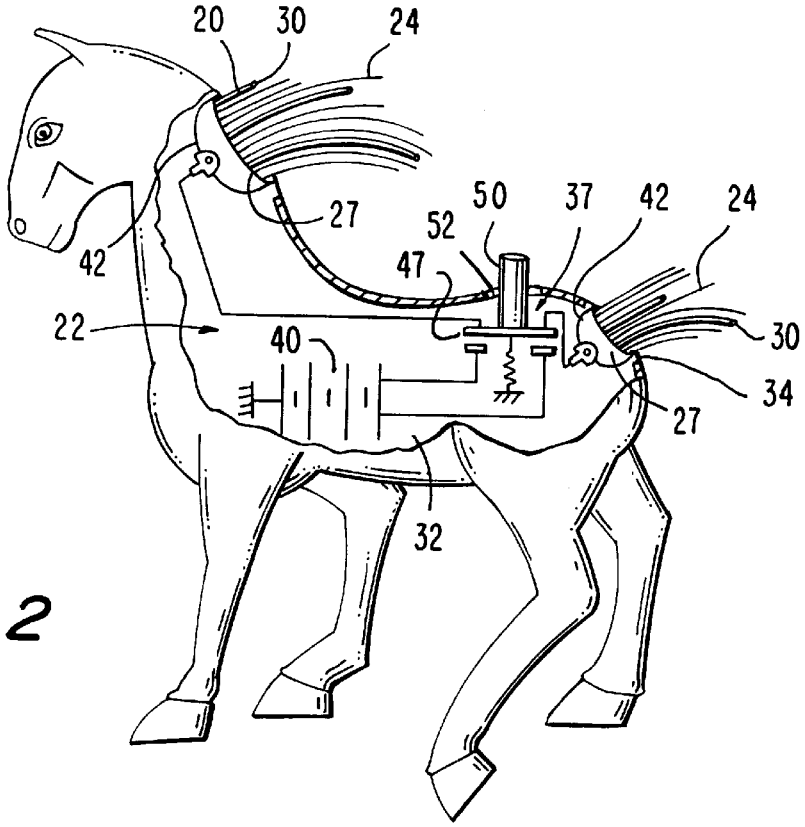
FIG. 2 is a side view of the figurine assembly of FIG. 1 with a portion of the figurine outer surface broken away to show the hollowed inner chamber and components disposed therein.
Figure 3:
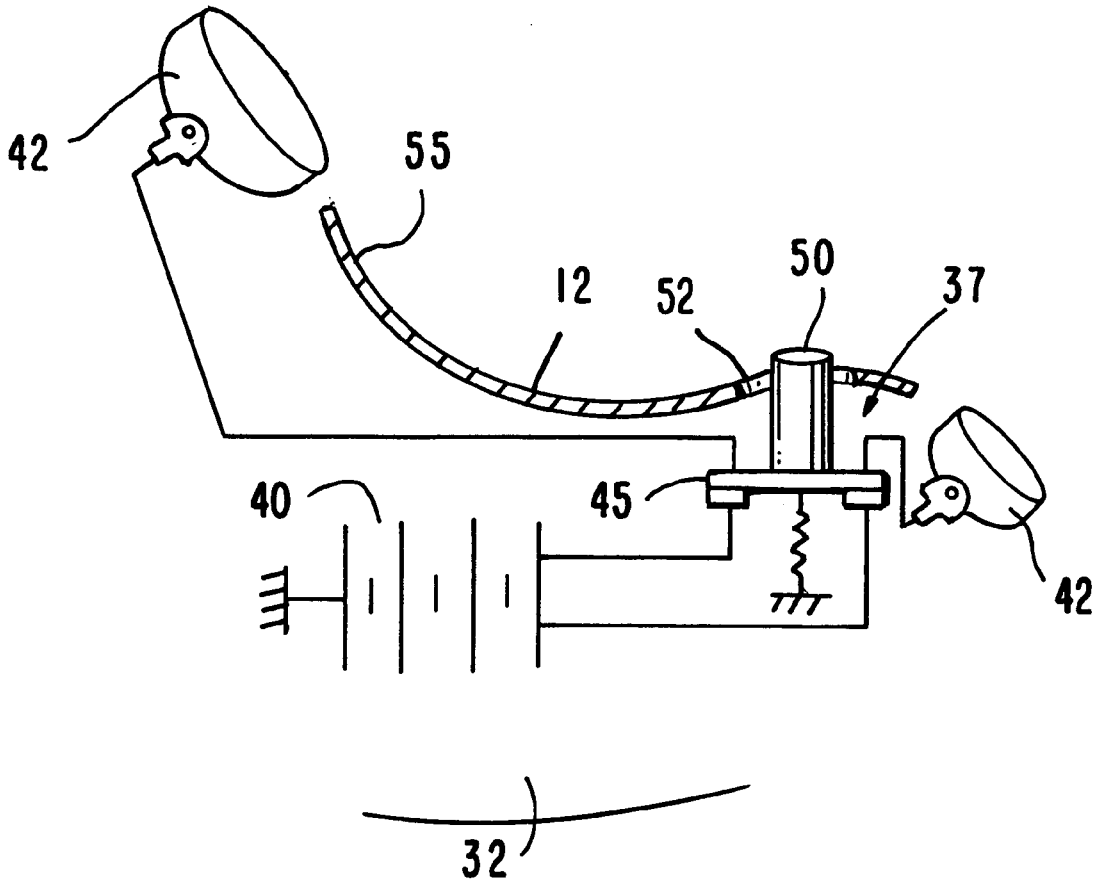
FIG. 3 is an enlarged, semi-schematic view of an internal portion of the figurine assembly of FIG. 2 showing the selectively-actuatable switch in its closed position.

More specifically, in the embodiment shown in FIGS. 1, 2 and 3, each fiber bunch 17 is formed of a plurality of optical fibers 20 interspersed in a generally (although not necessarily) numerically greater plurality of nonluminous fibers 24. Alternatively, the fiber bunch 17 may have a single optical fiber 20 interspersed in a plurality of nonluminous fibers 24 or the numbers of optical fibers and nonluminous fibers in the fiber bunch may be substantially the same.

It is generally contemplated that the elongated nonluminous fibers 24 extend outwardly from the figurine outer surface 15 at least a predetermined distance or length, although all of the nonluminous strands or fibers need not be of the same length or outward extension. In any event, at least a large proportion or the majority of the nonluminous fibers 24 will, in the most preferred embodiments of the invention, be of such a predetermined minimum length or extension from the figurine outer surface 15.

Each elongated optical fiber 20, extending between respective opposite optical fiber inner and outer ends 27, 30, is similarly defined as having a predetermined maximum length or outward extension defined between or proximate the figurine outer surface 15 and the optical fiber outer end 30. In preferred forms of the invention, the predetermined length of each optical fiber 20 is less than the minimum predetermined length of the nonluminous fibers 24. Alternatively, in embodiments in which the nonluminous fibers 24 are of varying lengths of extension from the figurine outer surface 15 as a function, by way of example, of their situs or location on or along the outer surface, each optical fiber 20 is preferably of a length less than at least the length(s) of the nonluminous fibers surrounding or disposed immediately proximate such optical fiber.

As should now or soon be apparent, it is thus generally the intention that the optical fiber outer ends 30 be located integrally within interior portions of the fiber bunch 17, surrounded by nonluminous fibers 24, so as to achieve the decorative illuminating effect provided in accordance with the invention. It should also be understood that embodiments in which the fiber bunch 17 incorporates an integral plurality of optical fibers 20 and wherein the optical fibers have a variety of different lengths, each generally less than the minimum predetermined length of at least those nonluminous fibers 24 closely proximate the respective optical fiber(s), are also within the intended scope and contemplation of the invention. This latter construction provides an arrangement in which the various optical fiber outer ends 30 terminate at different longitudinal positions within the fiber bunch 17 and thereby provide a plurality of pinpoints of illumination in and throughout the mane or tail (of the herein-disclosed simulated horse) or other figurine portion simulated by the outwardly-extending fiber bunch 17. In any event, it is thus generally anticipated that the one or more optical fibers 20 be—at least primarily if not entirely—of a length or lengths less than the length(s) of the nonluminous fibers 24 within which the optical fibers are disposed or bundled or interspersed so as to achieve the visually decorative effect that is operatively provided in accordance with the present invention as hereinafter described.

Each fiber bunch 17 is affixed to the figurine 12 and extends outwardly from within an inner chamber 32 of the optionally hollow figurine body through a fiber opening 34 to the outside or exterior of the figurine. Thus, the optical fiber inner ends 27 are located within the inner chamber 32 and the optical fiber outer ends 30 are located exteriorly of the outer surface of the figurine 12.

As shown in FIG. 2, in this illustrative embodiment the illuminating means 22 comprises a selectively-actuatable switch 37 and an electrical power source 40, such as a battery, located within the inner chamber 32. Also provided or carried in the inner chamber 32 are one or more lamps 42 disposed adjacent to the respective optical fiber inner ends 27. Each lamp 42—which may, by way of example, comprise a light emitting diode (LED) or a conventional incandescent bulb—is oriented to direct light toward or onto the respective optical fiber inner ends 27 of one or, more typically, a plurality of the optical fibers 20 in a longitudinal direction with respect to those portions of the elongations of the optical fibers adjoining the respective optical fiber inner ends.

The manually actuatable switch 37 is electrically connected in series to the lamps 42 and power source 40, as for example depicted in FIG. 2, and is moveable to a closed position 45 as shown in FIG. 3. When the switch 37 is in the closed position 45, the lamps 42 and power source 40 are electrically interconnected causing emission of light from the lamps 42 onto the adjacent optical fiber inner ends 27.

Light emitted from the lamps 42 onto the adjacent optical fiber inner ends 27 is transmitted or communicated longitudinally along the optical fibers 20 and thereby illuminates the optical fiber outer ends 30 to provide a single point of light at each optical fiber outer end. The illumination may optionally result in a point or pinpoint of light of a predetermined color, such as red, as a result of the color of the illumination provided by the lamps 42 and/or the properties of the optical fibers 20. Embodiments in which various ones of the plural optical fibers 20 in a bunch 17 provide points of light at their optical fiber outer ends 30 of respectively different colors are also within the intended scope of the invention.

It should be appreciated that the construction of the switch 37 and its arrangement with the lamps 42 and power source 40 in the electrical circuitry shown schematically in FIGS. 2 and 3 enables the optical fibers 20 in two or more separate fiber bunches 17 to be illuminated simultaneously. It should further be understood that embodiments in which the figurine 12 has affixed thereto more than two fiber bunches 17, each of which includes one or more optical fibers 20 illuminatable by a separate lamp 42 associated with each fiber bunch such that each of the lamps is interconnected with a single switch 37 in an electrical circuit like that shown schematically in FIGS. 2 and 3 such that moving the switch to the closed position 45 simultaneously illuminates all of the fiber bunches, are also within the intended scope and contemplation of the invention.

As shown in FIG. 2, the switch 37 is also moveable or returnable to an open position 47 wherein the electrical connection between the lamps 42 and power source 40 is interrupted to prevent or discontinue the emission of light from the lamps 42. In that open position 47, the optical fiber outer ends 30 are not illuminated and the presence of the optical fibers 20 within the fiber bunch 17 is substantially transparent—i.e. the viewer cannot readily tell that the fiber bunch is illuminatable in the manner provided with the switch 37 in its closed position 45.

In the herein-described form of the inventive figurine assembly 10, the switch 37 includes a control means comprising a spring-loaded member 50 extending through a switch opening 52 defined in the figurine outer surface 15 to provide external user access to the switch located within the inner chamber 32. The member 50 is manually depressible inwardly toward the inner chamber 32 to cause the switch 37 to move from its open position 47, shown in FIG. 2, to its closed position 45 shown in FIG. 3. The optional (but preferred) spring-loading of the member 50 resists the inward depression thereof and normally urges the member outwardly away from the inner chamber 32 to maintain or move or return the switch 37 to the open position 47 of FIG. 2 when the member is not selectively inwardly depressed by user-applied force or pressure.

The emission of light by the lamps 42 toward and onto the optical fiber inner ends 27 causes the optical fiber outer ends 30 to become illuminated without visibly illuminating the peripheral side walls of the optical fibers 20. Since the optical fiber outer ends 30 preferably have different longitudinal positions along the length(s) of the nonluminous fibers 24 and within and dispersedly throughout each fiber bunch 17, each fiber bunch appears to be integrally illuminated by numerous pinpoints of light distributed throughout the fiber bunch when the optical fiber outer ends are illuminated. Moreover, because both the nonluminous fibers 24 and the optical fibers 20 are preferably formed of materials by virtue of which the elongated strands or fibers are reasonably flexible, these pinpoints of light move with and somewhat independently of the nonluminous fibers 24 as the latter themselves independently flex and move. The effect is particularly striking where the pinpoints of light are of one or more colors.

As seen in FIG. 1, in the simulated horse figurine 12, one fiber bunch 17 extends from the top of the neck 55 to simulate a mane and a second fiber bunch extends from the rear portion 57 of the figurine to simulate a horse's tail. Where the figurine 12 is configured to resemble or simulate a different animal, or a human-type figure, or some other object, one or more fiber bunches 17 may be suitably located on or along the figurine outer surface 15 in the manner of hair or other appropriate fibrous or strand-like projections.

Finally, those skilled in the art will appreciate that the nonluminous fibers 24 may be formed of the same material as the optical fibers 20 even though the nonluminous fibers are not operatively illuminated. This construction provides a desirable uniformity to the mane or tail or other structure simulated by the bunch 17, and is accordingly preferred.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A fiber optic enhanced figurine assembly comprising:

a figurine having a figurine outer surface;

a bunch of elongated fibers affixed to said figurine and extending outwardly from said figurine outer surface, said fiber bunch comprising a plurality of nonilluminatable fibers each extending a distance from said figurine outer surface, and a plurality of illuminatable optical fibers each disposed closely proximate a plurality of said nonilluminatable fibers in surrounding relation with said each illuminatable optical fiber and each extending outwardly from said figurine outer surface to no greater than a second distance less than said distance of extension of said closely proximate surrounding nonilluminatable fibers, each of said plural illuminatable optical fibers extending from an inner end proximate said figurine outer surface to an outer end remote from said outer surface, and said plural illuminatable optical fibers being interspersed in and distributed throughout said nonilluminatable fibers; and means for selectively illuminating said inner ends of said plural illuminatable optical fibers so as to illuminate said outer ends of said plural optical fibers and thereby provide a plurality of individual points of illumination integrally within the fiber bunch to visually and decoratively enhance said fiber bunch;

wherein each of said plural illuminatable optical fibers has a longitudinal dimension within a range of longitudinal dimensions such that at least some of said plural optical fibers are of different lengths, said illumination means comprising a source of light disposed adjacent to said optical fiber inner ends and oriented for emitting light onto said optical fiber inner ends so as to illuminate said optical fiber outer ends which thereby define distinct points of light situated integrally and interiorly within said fiber bunch and distributed throughout said fiber bunch at plural longitudinal position therof to provide said fiber bunch with an appearance of integral illumination.

2. A fiber optic enhanced figurine assembly as set forth in claim 1, wherein said fiber bunch comprises a plurality of fiber bunch portions carried in spaced apart relation on and extending outwardly from said figurine outer surface.

3. A fiber optic enhanced figurine assembly as set forth in claim 2, wherein said figurine is shaped to simulate a horse including a rear portion and a neck, and wherein a first of said plural fiber bunches extends from said neck to simulate a mane and a second of said plural fiber bunches extends from said rear portion to simulate a tail.

4. A fiber optic enhanced figurine assembly as set forth in claim 1, wherein each said optical fiber inner end is disposed within an inner chamber defined by a hollow portion within said figurine, each said optical fiber extending outwardly from said inner chamber through a fiber opening defined in said figurine outer surface.

5. A fiber optic enhanced figurine assembly as set forth in claim 4, wherein said illumination means comprises a lamp disposed within said inner chamber proximate said optical fiber inner ends and oriented for operatively emitting light onto said optical fiber inner ends so as to illuminate said optical fiber outer ends which thereby define distinct points of light situated integrally within and distributed throughout said fiber bunch.

6. A fiber optic enhanced figurine assembly as set forth in claim 5, wherein said illuminating means further comprises a selectively-actuatable switch and an electric power source located within said inner chamber, said switch being electrically connected to said lamp and said power source, said switch being movable between a closed position wherein said lamp and power source are electrically interconnected causing an emission of light from said lamp and an open position wherein said electrical interconnection between said lamp and power source is obstructed such that said lamp is unilluminated, said switch including an operable control means accessible exteriorly of said figurine for controlling movement of said switch between said open and closed positions.

7. A fiber optic enhanced figurine assembly as set forth in claim 6, wherein said control means comprises a spring-loaded member extending through a switch opening defined in said figurine outer surface and manually depressible inwardly toward said inner chamber against a spring-defined return urgency to cause said switch to move from said open position to said closed position.

8. A fiber optic enhanced figurine assembly as set forth in claim 1, wherein said plural illuminatable optical fibers are constructed so that, when said plural illuminatable optical fibers are unilluminated by said selective illumination means, said plural illuminatable optical fibers are substantially transparent thereby limiting visibility of said plural illuminatable optical fibers in said fiber bunch when said plural illuminatable optical fibers are unilluminated by said illumination means.

9. A fiber optic enhanced figurine assembly as set forth in claim 1, wherein said figurine is shaped to simulate a horse including a rear portion and a neck, said fiber bunch extending from at least one of said neck to simulate a mane and said rear portion to simulate a tail.

10. A fiber optic enhanced figurine assembly as set forth in claim 1, wherein said plural nonilluminatable fibers are formed of an identical material to thereby provide an enhanced uniformity of content and appearance of said fiber bunch both when said illuminatable optical fibers are illuminated and when said illuminatable optical fibers are unilluminated.

* * * * *